US011845276B2

(12) United States Patent
Han et al.

(10) Patent No.: US 11,845,276 B2
(45) Date of Patent: Dec. 19, 2023

(54) INKJET HEAD AND METHOD OF EJECTING INK USING THE SAME

(71) Applicant: STI CO., LTD., Anseong-si (KR)

(72) Inventors: Kyu Yong Han, Anseong-si (KR); Myeong Jin Kim, Anseong-si (KR)

(73) Assignee: STI CO., LTD., Anseong-si (KR)

( * ) Notice: Subject to any disclaimer, the term of this patent is extended or adjusted under 35 U.S.C. 154(b) by 51 days.

(21) Appl. No.: 17/675,484

(22) Filed: Feb. 18, 2022

(65) Prior Publication Data

US 2022/0288932 A1 Sep. 15, 2022

(30) Foreign Application Priority Data

Mar. 9, 2021 (KR) ..... 10-2021-0030854

(51) Int. Cl.
*B41J 2/14* (2006.01)

(52) U.S. Cl.
CPC ..... *B41J 2/14201* (2013.01)

(58) Field of Classification Search
CPC .... B41J 2/14201; B41J 2202/09; B41J 2/035; B41J 2/04581; B41M 5/0047; C09D 11/50
See application file for complete search history.

(56) References Cited

FOREIGN PATENT DOCUMENTS

KR 10-2019-0137742 12/2019

OTHER PUBLICATIONS

Ryu An Na et al., "Inkjet Printing Apparatus, Method of Aligning Dipolar Elements And Method of Fabricating Display Device", Feb. 4, 2021, Description of Embodiments, Figures 1-6 and 11 (Year: 2021).*

* cited by examiner

*Primary Examiner* — Lisa Solomon
(74) *Attorney, Agent, or Firm* — KILE PARK REED & HOUTTEMAN PLLC

(57) ABSTRACT

Disclosed is an inkjet head and a method of ejecting an ink using the same. An inkjet head according to one embodiment of the present invention may include nozzles each including a ejecting hole through which a solution including a light-emitting element is ejected and pairs of electrodes which are provided around the ejecting holes to face each other and which apply an electrode voltage to the light-emitting element.

8 Claims, 10 Drawing Sheets

INKJET HEAD AND METHOD OF EJECTING INK USING THE SAME

CROSS-REFERENCE TO RELATED APPLICATION

This application claims priority to and the benefit of Korean Patent Application No. 10-2021-0030854, filed on Mar. 9, 2021, the disclosure of which is incorporated herein by reference in its entirety.

BACKGROUND

1. Field of the Invention

The present invention relates to an inkjet head and a method of ejecting an ink using the same, and more specifically, to an inkjet head used in a manufacturing process of a display device and a method of ejecting an ink using the same.

2. Discussion of Related Art

Display devices are classified into liquid crystal displays (LCDs), organic light emitting diode (OLED) displays, plasma display panels (PDPs), micro-light emitting diodes (LEDs), quantum nano emitting diode (QNED) displays, and the like according to a light-emitting method.

Among them, the QNED display is a display using a light-emitting element based on quantum dots, which are nanometer size ultra-small semiconductor particles, and gallium nitride (GaN).

The light-emitting element has a nanorod type having a long stick shape and an ultra-small size. The QNED is formed by jetting and arranging light-emitting elements on each of pixels through an inkjet printing process.

In a Korean patent publication (Patent Publication No. 10-2019-0137742, "LED ELECTRODE ASSEMBLY AND MANUFACTURING METHOD THEREOF"), a method of manufacturing an LED electrode assembly which is capable of preventing electrode damage and a short circuit which may occur when LED elements are arranged is disclosed, but it has a problem in that the LED element having a predetermined length in an arrangement process after a jetting operation is not properly arranged in the jetting and arranging processes due to shape specificity of the light-emitting element.

RELATED ART

Patent Document (Patent Document 0001) Korean Patent Publication No. 10-2019-0137742 (Published Date: Dec. 11, 2019)

SUMMARY OF THE INVENTION

The present invention is directed to providing an inkjet head capable of improving arrangement accuracy of light-emitting elements in a manufacturing process of a display device and a method of ejecting an ink using the same.

The present invention provides an inkjet head in order to solve the technical problem. According to an aspect of the present invention, there is provided an inkjet head including nozzles each including a ejecting hole through which a solution including a light-emitting element is ejected and pairs of electrodes which are provided around the ejecting hole to face each other and which apply an electrode voltage to the light-emitting element.

The inkjet head may further include an insulating layer interposed between end portions of the nozzles and the electrodes.

The nozzles may be disposed to form one or more rows, and the electrodes may include first electrodes provided in a row along one end portions of the plurality of adjacent nozzles and second electrodes provided in a row along the other end portions of the nozzles in a direction opposite to a direction of the first electrodes.

The first electrodes may be disposed a predetermined distance apart from the second electrodes in one direction.

The inkjet head may further include a first piezoelectric element which changes an internal pressure of a reservoir filled with the solution, an actuator which changes a piezoelectric element voltage applied to the first piezoelectric element to eject the solution through the ejecting hole, and a controller which controls a magnitude of an electrode voltage applied to the electrodes, wherein the controller may control the magnitude of the electrode voltage independently of the piezoelectric element voltage based on the piezoelectric element voltage.

The inkjet head may further include a second piezoelectric element interposed between the end portions of the nozzles and the electrodes.

The present invention provides a method of ejecting an ink in order to solve the technical problem.

According to an aspect of the present invention, there is provided a method of ejecting an ink comprising a first arrangement operation of applying an electrode voltage to a ejecting hole of a nozzle through which a solution including a light-emitting element is supplied so as to arrange one end portion and the other end portion of the light-emitting element in an arbitrary direction, a jetting operation of jetting the solution on a substrate on which a first substrate electrode and a second substrate electrode are disposed to be spaced apart from each other, and a second arrangement operation of applying power to the substrate so that the one end portion of the light-emitting element is disposed on the first substrate electrode and the other end portion is disposed on the second substrate electrode.

Before a jetting process in the jetting operation is performed, the first arrangement operation and the jetting process are concurrently performable.

In the first arrangement operation, an electrode voltage having a magnitude which is different from a magnitude of a piezoelectric element voltage for ejecting the solution through the ejecting hole may be applied.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present invention will be described in detail with reference to the accompanying drawings. However, the technical spirit of the present invention is not limited to the embodiments which will be described in this specification and may be realized with different forms. Further, the embodiments introduced in this specification are provided so that the disclosed content is thorough and complete and the spirit of the present invention is sufficiently conveyed to those skilled in the art.

In the present specification, when a certain component is described as being present on another component, it means that the component may be directly disposed on another component, or a third component may be interposed therebetween. In addition, in the accompanying drawings, shapes and sizes are exaggerated to effectively describe the technical content.

In addition, although the terms "first," "second," "third," and the like are used herein to describe various elements in the various embodiments of the present specification, these elements should not be limited by these terms. These terms are only used to distinguish a certain element from another element. Accordingly, an element described as a first element in any one embodiment may be described as a second element in another embodiment. The embodiments described and illustrated in this specification include complementary embodiments thereof. In addition, the term "and/or" is used to include at least any one of elements listed therebefore and thereafter.

The singular forms are intended to include the plural forms, unless the context clearly indicates otherwise. In addition, the terms "comprise," "include," or the like specify the presence of features, numbers, steps, operations, elements, or combinations thereof which are described in the specification, but do not preclude the presence or addition of one or more other features, numbers, steps, operations, elements, or combinations thereof. In addition, in this specification, the term "connect" is used to include both indirect and direct connection of a plurality of elements.

In addition, in the following description, when it is determined that detailed descriptions of related well-known functions or configurations unnecessarily obscure the gist of the present invention, the detailed descriptions thereof will be omitted.

Figure 1:
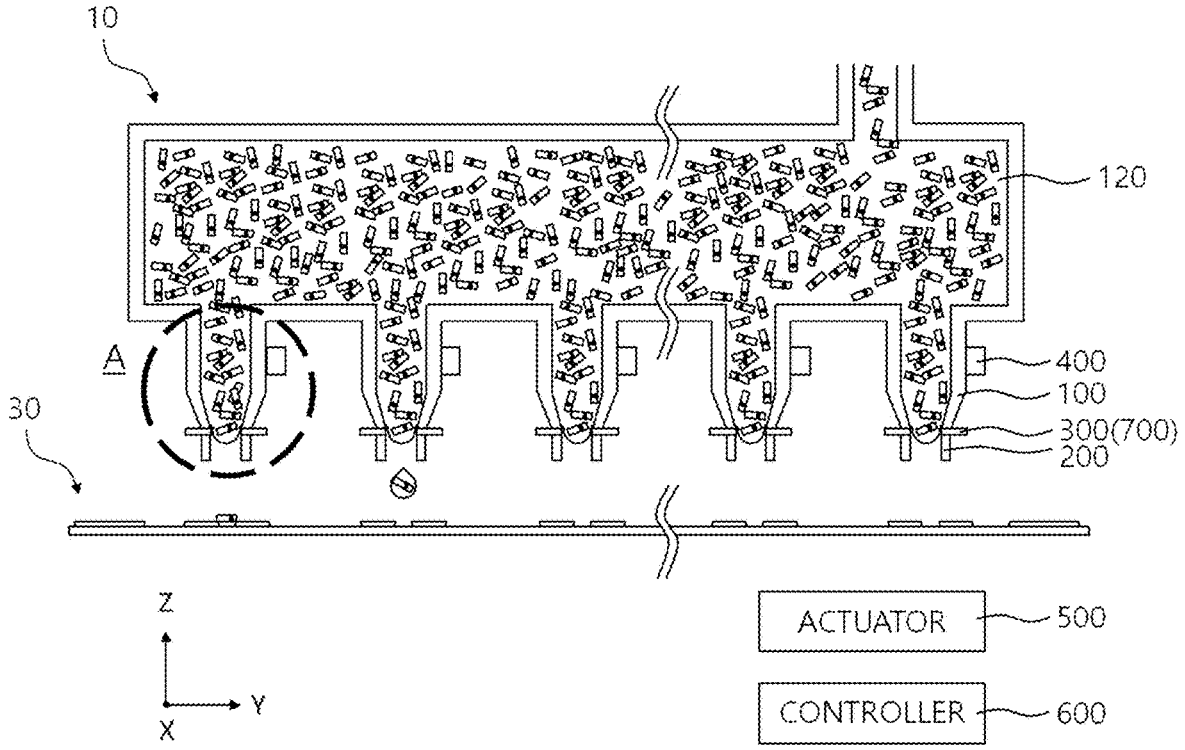
FIG. 1 is a front view illustrating an inkjet head and a substrate according to one embodiment of the present invention.
Figure 2:
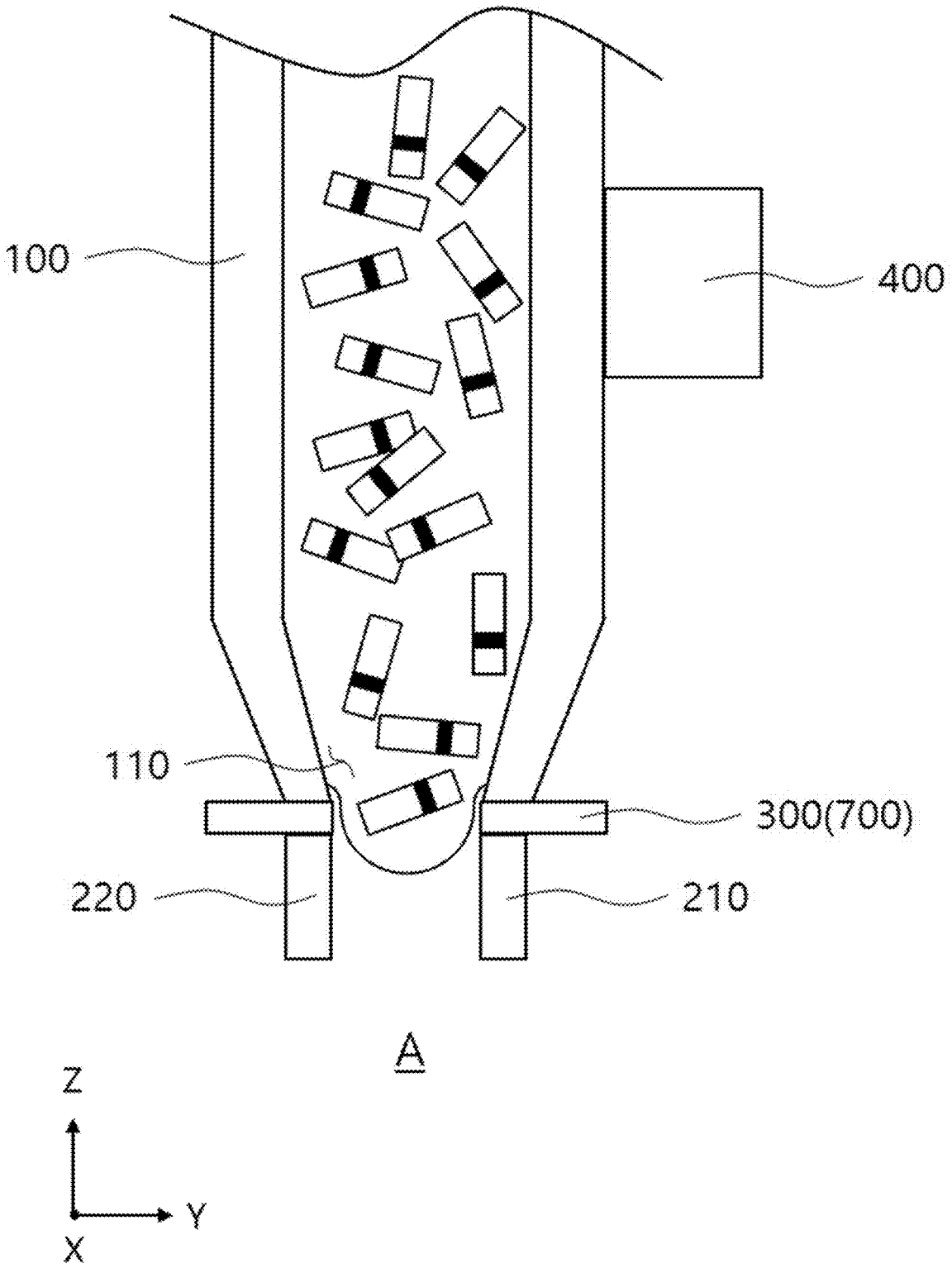
FIG. 2 is an enlarged view illustrating portion A in FIG. 1.
Figure 3A:
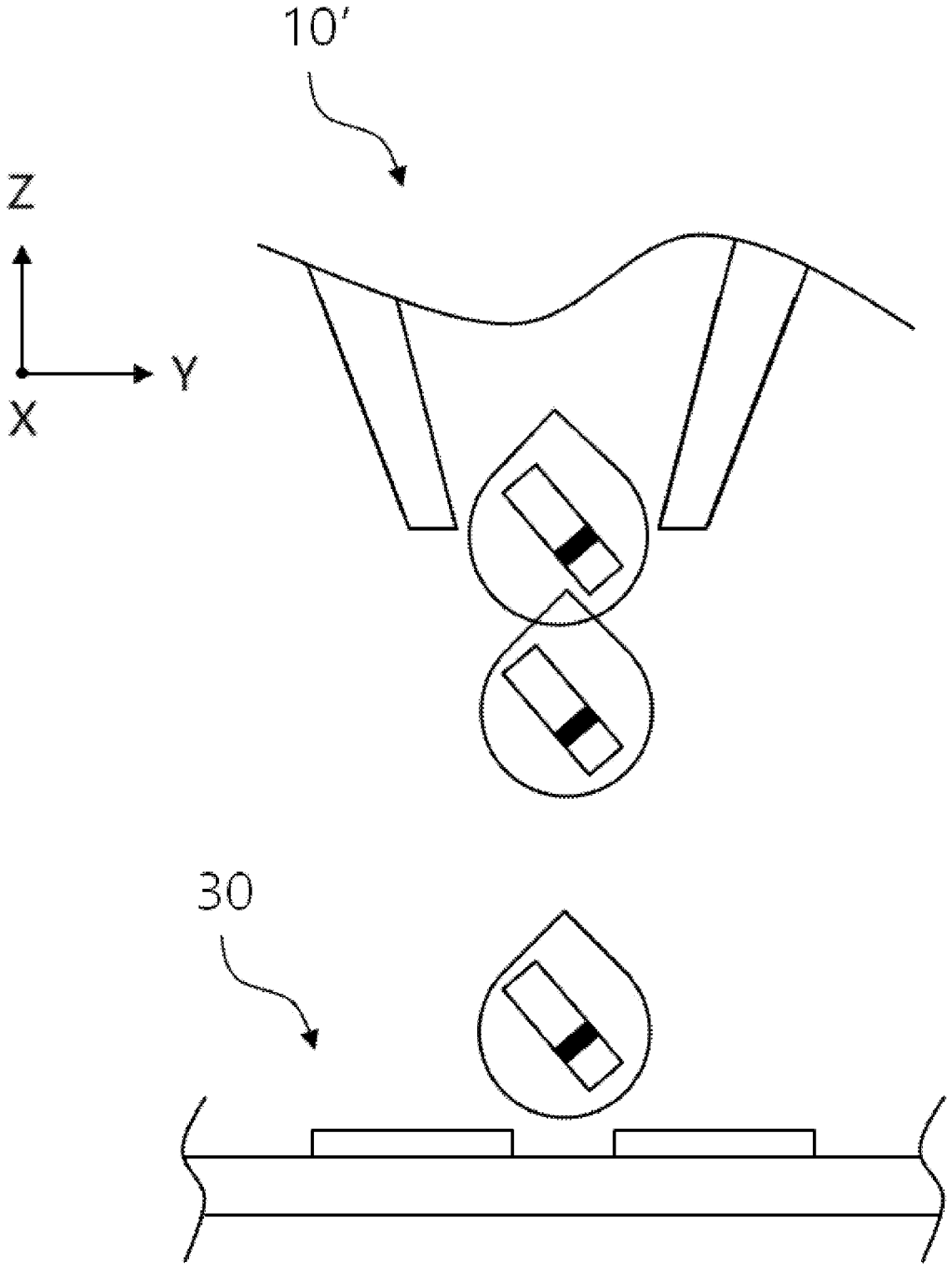
FIG. 3A is a schematic view illustrating a moving state of a solution ejected from a conventional inkjet head.
Figure 3B:
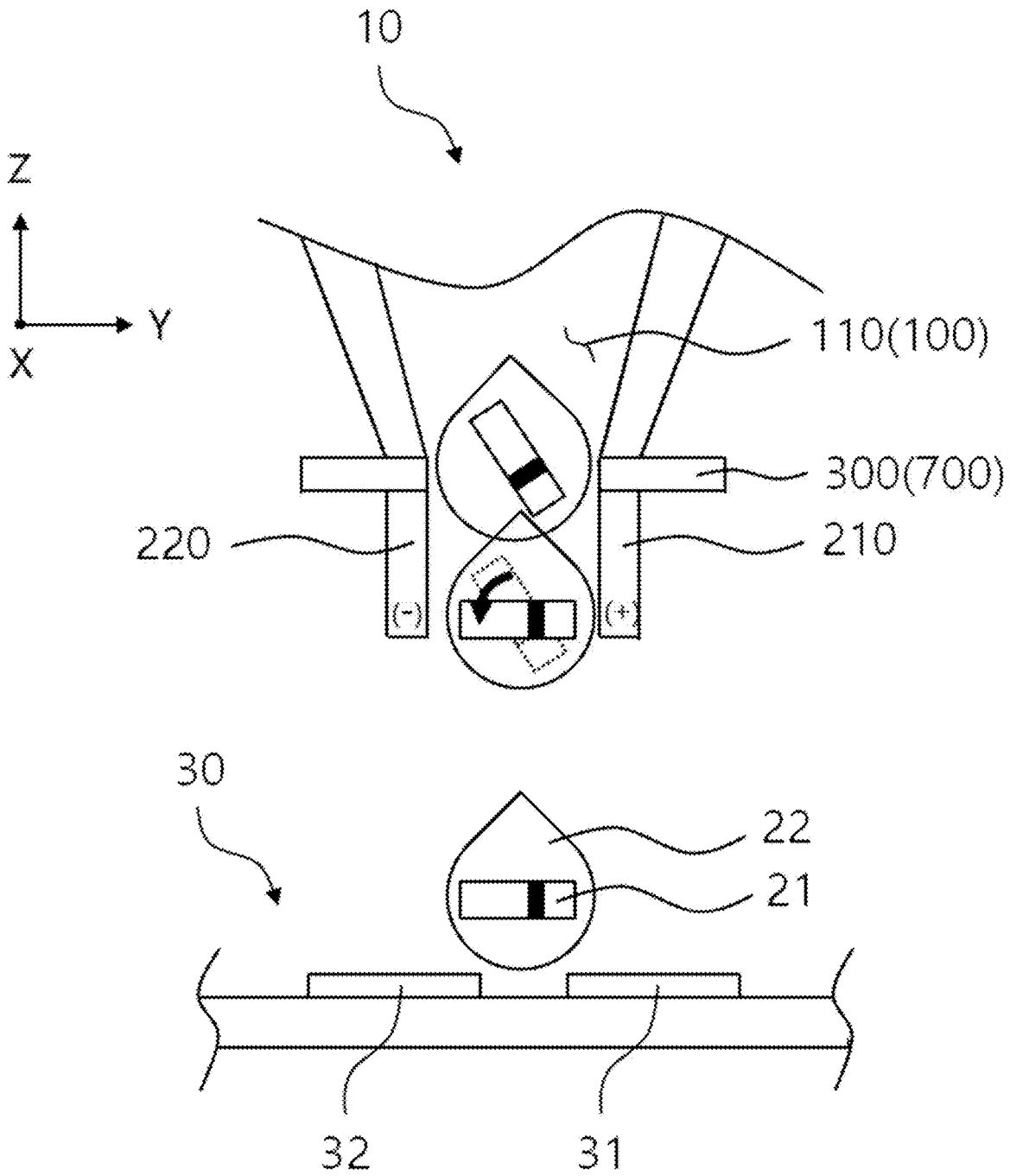
FIG. 3B is a schematic view illustrating a moving state of a solution ejected from an inkjet head according to one embodiment of the present invention.
Figure 4:
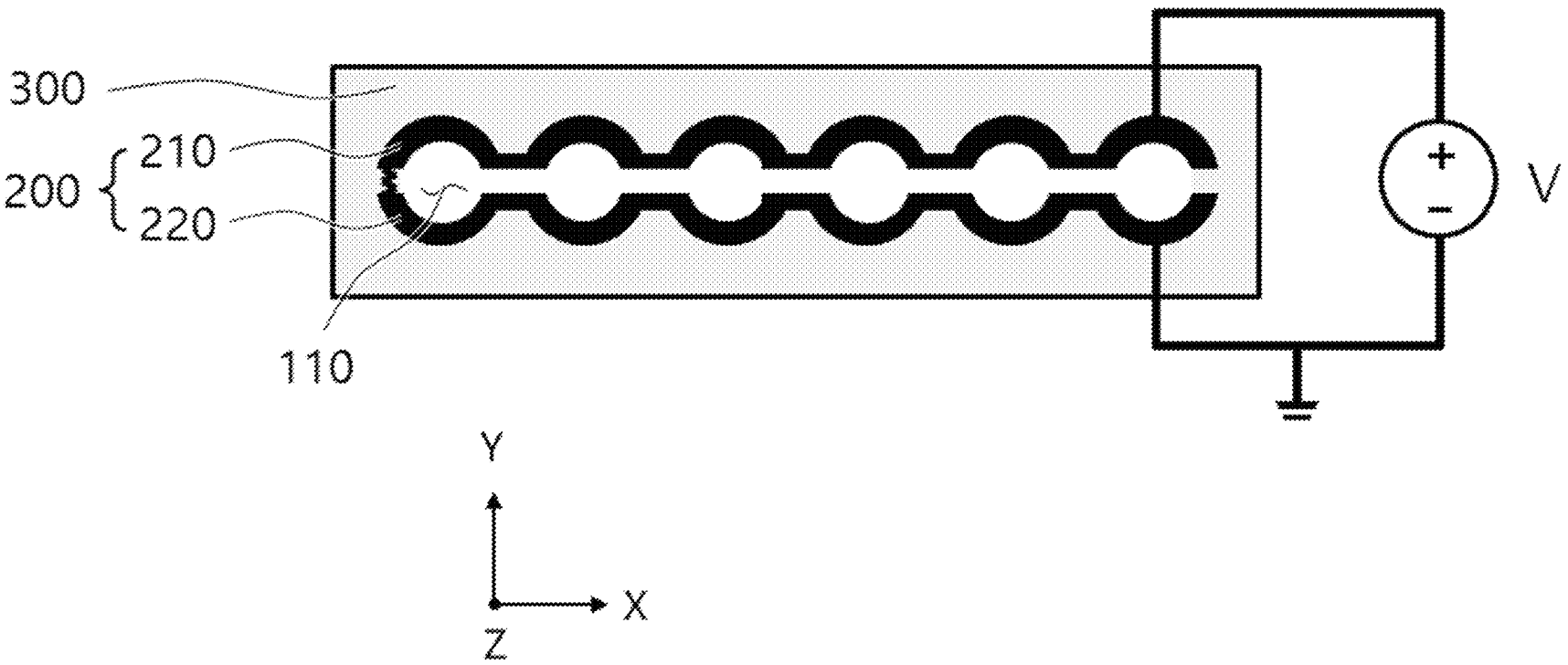
FIG. 4 is a bottom view illustrating the inkjet head according to one embodiment of the present invention.
Figure 5A:
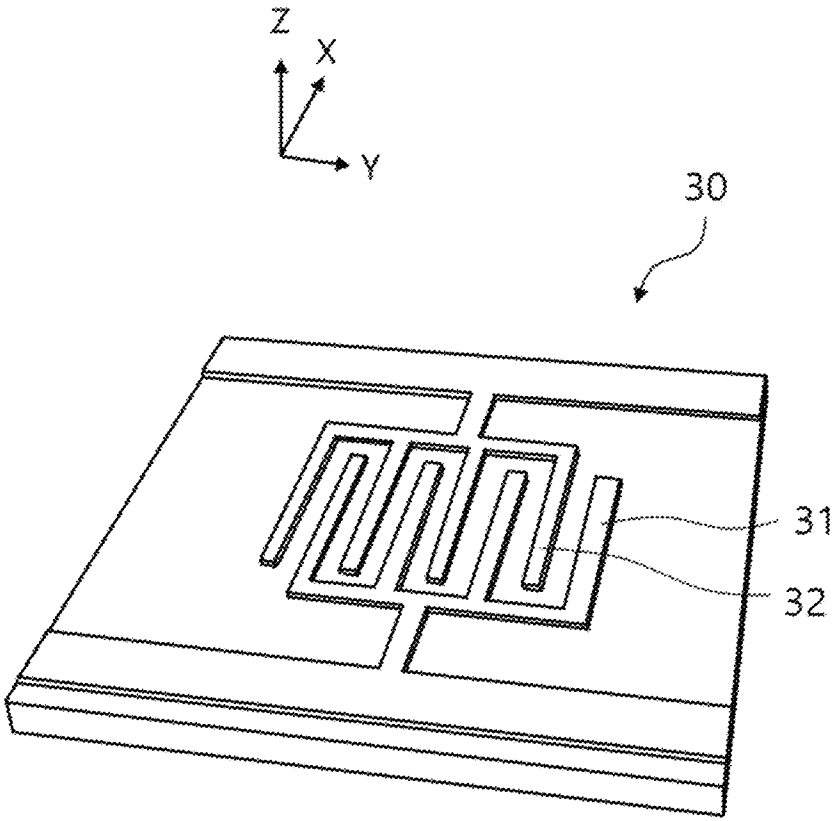
FIG. 5A is a schematic perspective view illustrating a substrate on which a first electrode and a second electrode according to one embodiment of the present invention are mounted.
Figure 5B:
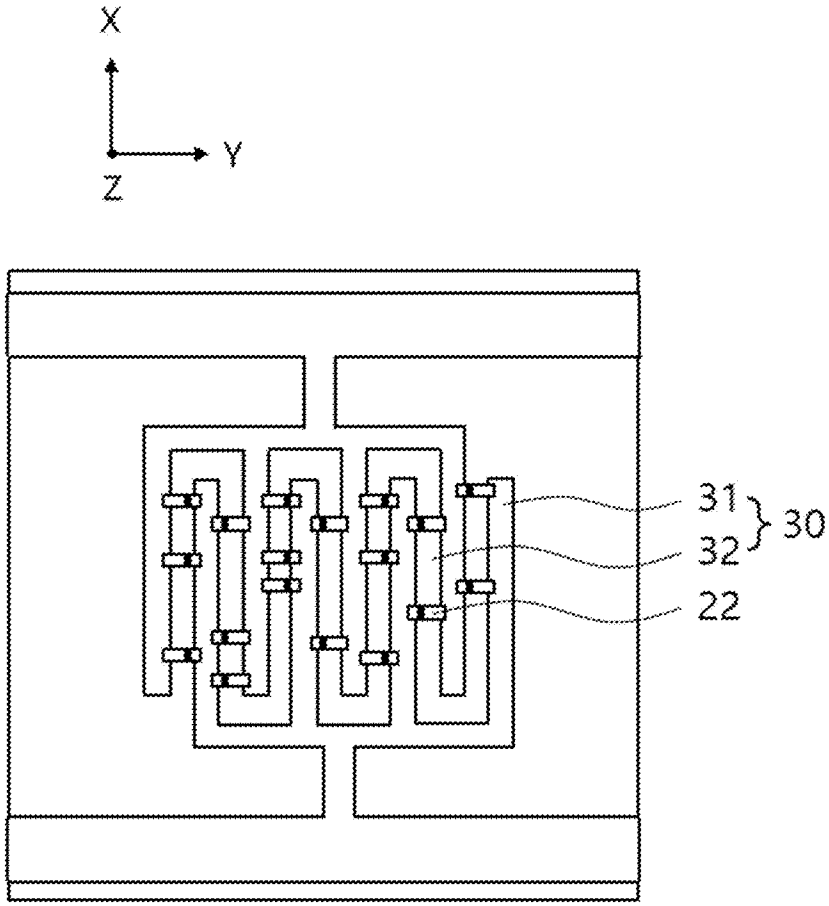
FIG. 5B is a plan view illustrating the substrate on which light-emitting elements in an arranged state is provided according to one embodiment of the present invention.
Figure 6A:
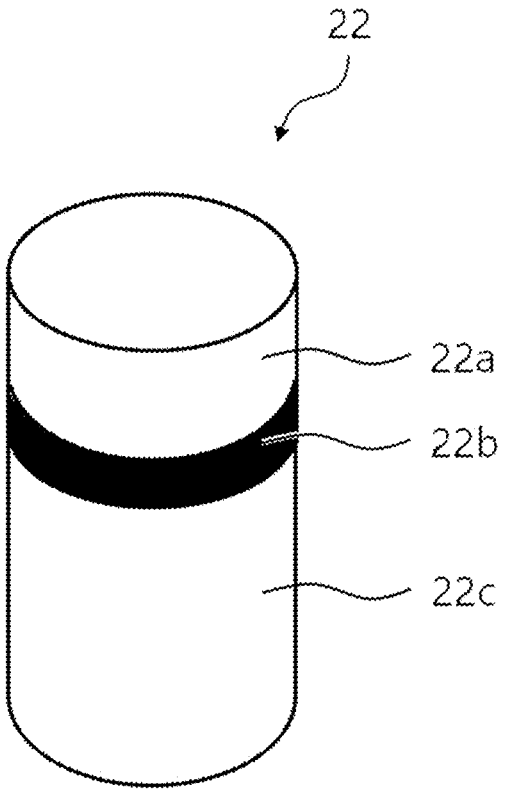
FIGS. 6A and 6B are views illustrating the light-emitting element according to one embodiment of the present invention.
Figure 6B:
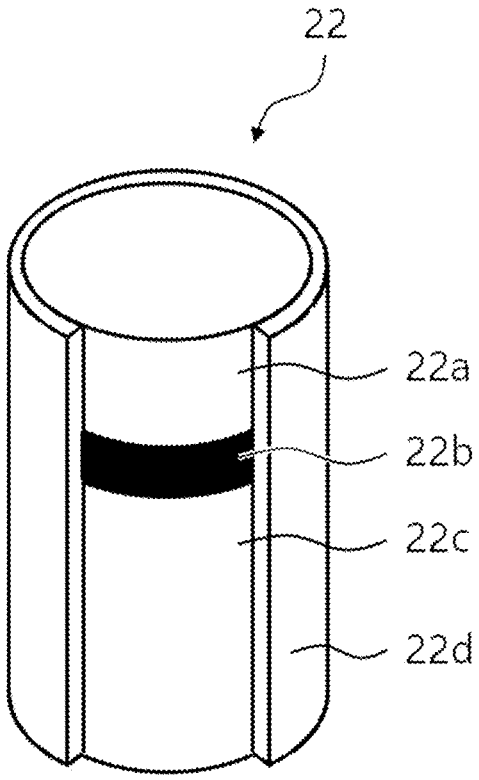

FIG. 1 is a front view illustrating an inkjet head 10 and a substrate 30 according to one embodiment of the present invention, FIG. 2 is an enlarged view illustrating portion A in FIG. 1, FIG. 3A is a schematic view illustrating a moving state of solutions 21 and 22 ejected from a conventional inkjet head 10', FIG. 3B is a schematic view illustrating a moving state of solutions 21 and 22 ejected from the inkjet head 10 according to one embodiment of the present invention, FIG. 4 is a bottom view illustrating the inkjet head 10 according to one embodiment of the present invention, FIG. 5A is a schematic perspective view illustrating the substrate 30 on which a first electrode 210 and a second electrode 220 according to one embodiment of the present invention are mounted, FIG. 5B is a plan view illustrating the substrate 30 on which light-emitting elements 22 in an arranged state are provided according to one embodiment of the present invention, and FIGS. 6A and 6B are views illustrating the light-emitting element 22 according to one embodiment of the present invention.

Hereinafter, components of the inkjet head 10 according to one embodiment of the present invention will be described in detail.

Referring to FIGS. 1 to 6B, the inkjet head 10 according to one embodiment of the present invention may be a device configured to provide the solutions 21 and 22 including the light-emitting elements 22 to the substrate 30. The inkjet head 10 may include nozzles 100 and electrodes 200 and may further include insulating layers 300, first piezoelectric elements 400, an actuator 500, a controller 600, and second piezoelectric elements 700.

Referring back to FIGS. 1 to 4, the nozzles 100 may include ejecting holes 110. The ejecting holes 110 may eject the solutions 21 and 22 including the light-emitting elements 22.

The nozzles 100 may be disposed to form one or more rows.

A reservoir 120 may accommodate the solutions 21 and 22. One end of the reservoir 120 may communicate with the ejecting holes 110.

Referring back to FIGS. 1 to 3B, the solutions 21 and 22 may include a dispersion solvent 21. Preferably, the dispersion solvent 212 may be any one or more from the group consisting of acetone, water, alcohol, or toluene, but is not limited thereto, and any solvent may be used without limitation as long as the light-emitting elements 22 are not physically or chemically affected and the volatilization performance thereof is high.

Referring back to FIGS. 1 to 6B, the light-emitting elements 22 may be rotated in the dispersion solvent 21 by electrostatic attractive forces of the first electrode 210 and the second electrode 220 in an arbitrary direction. The light-emitting elements 22 may be jetted after a first arrangement is performed so that the light-emitting elements 22 are arranged on a first electrode 210 and a second electrode 220 to face each other before the light-emitting elements 22 are jetted.

The light-emitting elements 22 may be formed so that a first conductive semiconductor layer 22*a* and a second conductive semiconductor layer 22*c* are formed on both end portions of an active layer 22*b* in a longitudinal direction. Referring to FIG. 6A, the light-emitting element 22 may include the first conductive semiconductor layer 22*a*, the active layer 22*b* formed on the first conductive semiconductor layer 22*a*, and the second conductive semiconductor layer 22*c* formed on the active layer 22*b*. Referring to FIG. 6B, an insulating layer 22*d* may be formed on an outer circumference of the light-emitting element 22 to surround the first conductive semiconductor layer 22*a*, the active layer 22*b*, and the second conductive semiconductor layer 22*c*.

Any one of the first conductive semiconductor layer 22*a* and the second conductive semiconductor layer 22*c* may be an n-type semiconductor layer, and the other may be a p-type semiconductor layer.

According to one embodiment, when the first conductive semiconductor layer 22*a* is the n-type semiconductor layer, at least one or more may be selected from semiconductor materials having a composition formula of $In_xAl_yGa_{1-x-y}N$ ($0 \le x \le 1$, $0 \le y \le 1$, $0 \le x+y \le 1$), for example, InAlGaN, GaN, AlGaN, InGaN, AlN, or InN, as the first conductive semiconductor layer 22*a*, and a first conductive dopant may be doped. The first conductive dopant may be Si, Ge, or Sn, but is not limited thereto. When the second conductive semiconductor layer is the p-type semiconductor layer, at least one or more may be selected from semiconductor materials having a composition formula of $In_xAl_yGa_{1-x-y}N$ ($0 \le x \le 1$, $0 \le y \le 1$, $0 \le x+y \le 1$), for example, InAlGaN, GaN, AlGaN, InGaN, AlN, or InN, as the p-type semiconductor layer, and a second conductive dopant may be doped. The second conductive dopant may be Mg but is not limited thereto.

The active layer 22*b* may be interposed between the first conductive semiconductor layer 22*a* and the second conductive semiconductor layer 22*c* and may have a single or multi quantum well structure. A general active layer 22*b* included in a general light-emitting element 22 used in a lighting, a display, and the like may be used as the active layer 22*b*. When an electric field due to a predetermined voltage or more is applied to both ends of the light-emitting elements 22, electron-hole pairs are coupled in the active layer 22*b* so that the light-emitting elements 22 may emit light.

The insulating layer 22*d* may be provided to surround all or some of the first conductive semiconductor layer 22*a*, the active layer 22*b*, and the second conductive semiconductor layer 22*c*. The insulating layer 22*d* may be formed of a transparent material. The insulating layer 22*d* may be at least one or more among $SiO_2$, $Si_3N_4$, $Al_2O_3$, and $TiO_2$ but is not limited thereto.

The insulating layer 22*d* may prevent a short circuit between the light-emitting elements 22 randomly positioned in the dispersion solvent 21.

The light-emitting element 22 may have a rod shape. An aspect ratio of the light-emitting element 22 may be in the range of 1.2 to 100, preferably 1.2 to 50, more preferably 1.5 to 20, and more preferably 1.5 to 10.

The light-emitting element 22 may have a nanoscale diameter and/or length.

Referring back to FIGS. 1 to 4, pairs of the electrodes 200 may be formed on the ejecting holes 110 to face each other. The electrodes 200 according to one embodiment may be provided at front ends of the ejecting holes 110. The electrodes 200 may apply an electrode voltage to the light-emitting elements 22. The electrodes 200 may include first electrodes 210 and second electrodes 220. The electrodes 200 may apply an alternating current voltage.

An arbitrary potential difference may occur between the first electrodes 210 and the second electrodes 220. The first electrodes 210 according to one embodiment may be provided in one row along one end portions of the plurality of adjacent nozzles 100.

The first electrodes 210 may be disposed a predetermined distance from the second electrodes 220. The first electrodes 210 may be provided to be disposed in parallel to face a first substrate electrode 31. The first electrodes 210 and the second electrodes 220 may be disposed to face the first substrate electrode 31 and the second substrate electrode 32.

The first electrodes 210, along with the second electrodes 220, may be provided to be disposed to surround the front ends of the ejecting holes 110.

The first electrodes 210 may be formed of at least one or more metals among aluminum, titanium, indium, gold, and silver or at least one or more transparent materials among indium tin oxide (ITO), ZnO:Al, and a carbon nano tube (CNT)-conductive polymer composite. When the first electrode 210 is formed of two or more materials, the materials may be formed to be stacked on each other.

The second electrodes 220 may be provided to face the first electrodes 210 and spaced the predetermined distance apart from the first electrodes 210. The second electrodes 220 according to one embodiment may be provided in a row at the other end portions of the nozzles 100. The second electrodes 220 may be provided to be disposed in parallel to face a second substrate electrode 32.

The second electrodes 220 may be formed of at least one or more metals among aluminum, titanium, indium, gold, and silver or at least one or more transparent materials among indium tin oxide (ITO), ZnO:Al, and a carbon nano tube (CNT)-conductive polymer composite. The second electrode 220 may be formed of a material which is the same as or different from a material of the first electrode 210.

The first electrodes 210 and the second electrodes 220 according to one embodiment may be arranged to correspond with each other in any one direction according to arrangement positions of the first substrate electrode 31 and the second substrate electrode 32 disposed on the substrate 30. According to one embodiment, the first electrodes 210 may be provided to face the second electrodes 220 in a Y-axis direction. The first electrodes 210 may be connected to a voltage source, a resistor, and the second electrodes 220 in series.

Referring back to FIGS. 1 and 3B, in a first nozzle 100, an electrode voltage may be provided so that the first electrode 210 is arranged parallel to the first substrate electrode 31, and the second electrode 220 is arranged parallel to the second substrate electrode 32, in an X-axis direction, respectively, and in a second nozzle 100, an electrode voltage may be provided so that the first electrode 210 is arranged parallel to the second substrate electrode 32 and the second electrode 220 is arranged parallel to the first substrate electrode 31.

Referring back to FIGS. 1 to 4, the insulating layer 300 may prevent the nozzle 100 from being short-circuited with the electrode 200. The insulating layer 300 may be interposed between an end portion of the nozzle 100 and the electrode 200. The insulating layer 300 may insulate the electrode 200 from the end portion of the nozzle 100. The insulating layer 300 may prevent an electrical short circuit between the end portion of the nozzle and the first electrode or the second electrode and damage thereof due to the solvent or conductive impurities provided in a process of jetting the solutions 21 and 22 including the light-emitting elements 22. The insulating layer 300 may be formed of at least any one among $SiO_2$, $Si_3N_4$, $SiN_x$, $Al_2O_3$, $HFO_2$, $Y_2O_3$, and $TiO_2$ but is not limited thereto. According to one embodiment, the insulating layer 300 may be formed of silicon nitride ($SiN_x$).

Referring back to FIGS. 1 and 2, the actuator 500, which will be described below, may drive the first piezoelectric elements 400 to generate a pressure against the solutions 21 and 22. The first piezoelectric elements 400 may change an internal pressure of the reservoir 120. The reservoir 120 may be filled with the solutions 21 and 22.

Referring back to FIG. 1, the actuator 500 may apply a piezoelectric element voltage having an arbitrary value to the first piezoelectric elements 400. The actuator 500 may change the arbitrary piezoelectric element voltage to control the solutions 21 and 22 to be ejected through the ejecting holes 110.

When the actuator 500 drives the first piezoelectric elements 400, an internal volume of the reservoir 120 may be reduced, and thus the solutions 21 and 22 may be ejected through the ejecting holes 110 due to a change in pressure of the reservoir 120.

Referring back to FIG. 1, the controller 600 may adjust a magnitude of an electrode voltage applied to the electrode. The controller 600 may require information of the actuator 500. The controller 600 may receive a value of a piezoelectric element voltage from the actuator 500. The controller 600 may arbitrarily control the magnitude of the electrode voltage applied to the electrodes 200 independently of the value of the piezoelectric element voltage.

Referring back to FIGS. 1 to 3B, the second piezoelectric element 700 may be interposed between the end portion of the nozzle 100 and the electrode 200. The second piezoelectric element 700 may provide a ejecting pressure with the same phase as the first piezoelectric element 400.

The second piezoelectric elements 700 may be synchronized with the first piezoelectric elements 400 to form a predetermined acoustic vibration. The second piezoelectric elements 700 may add wave energy to wave energy applied to the ejecting holes 110 by the first piezoelectric elements 400 to increase a ejecting force of the solutions 21 and 22 at the ejecting holes 110.

The second piezoelectric elements 700 according to one embodiment may be selectively formed along with the insulating layer 300. The second piezoelectric element 700 according to another embodiment may be provided to be interposed between an insulating layer 300 and the electrode 200.

Referring back to FIGS. 1, 2, 5A, and 5B, the substrate 30 may include the first substrate electrode 31 and the second substrate electrode 32. The first substrate electrode 31 may be disposed a predetermined distance apart from the second substrate electrode 32 on the substrate in one direction. The first substrate electrode 31 according to one embodiment may be provided to face the second substrate electrode 32 in the Y-axis direction.

The substrate 30 may be formed of a rigid or flexible material. The substrate 30 may be at least one among a glass substrate, a crystal substrate, a sapphire substrate, a plastic substrate, or a flexible substrate such as a polymer film, and may be a substrate on which an electrode may be formed. According to one embodiment, the substrate 30 may be formed of a transparent material but is not limited thereto. In addition, the substrate 30 may also be formed of a translucent, opaque, or reflective material.

Hereinafter, a method of ejecting an ink using the inkjet head 10 according to one embodiment of the present invention will be described according to time series.

Figure 7:
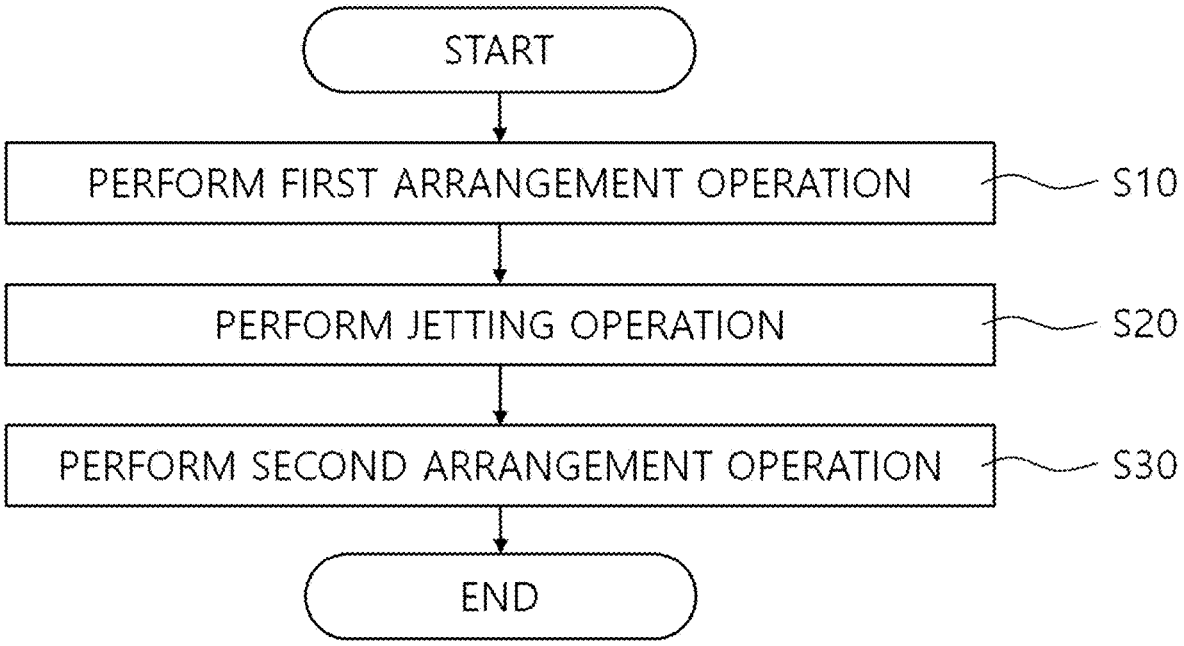
FIG. 7 is a flowchart illustrating a method of ejecting an ink according to one embodiment of the present invention.

FIG. 7 is a flowchart illustrating the method of ejecting an ink according to one embodiment of the present invention.

Referring to FIG. 7, the method of ejecting an ink according to one embodiment of the present invention may provide the light-emitting elements on the substrate in order from operations of performing a first arrangement before the solutions including the light-emitting element are jetted, applying the solutions including the light-emitting elements, performing a second arrangement of the light-emitting elements, and removing the solvent.

The method of ejecting an ink according to one embodiment of the present invention may include a first arrangement operation (S10), a jetting operation (S20), and a second arrangement operation (S30)

In the first arrangement operation S10, one end portions and the other end portions of the light-emitting elements may be arranged in an arbitrary direction by applying an electrode voltage to the ejecting hole of the nozzle through which the solutions including the light-emitting elements are supplied.

Before a jetting process of the jetting operation, the first arrangement operation S10 and the jetting process may be concurrently performed.

In the first arrangement operation S10, an electrode voltage having a magnitude different from that of a piezoelectric element voltage for ejecting the solutions through the ejecting hole may be applied.

In the first arrangement operation S10, the light-emitting elements may be rotated in an arbitrary direction by applying an electrostatic attractive force using dipole characteristics of the light-emitting elements before the solutions including the light-emitting elements are ejected from the inkjet head in the jetting operation.

In the jetting operation S20, the light-emitting elements may be jetted and applied on the substrate by ejecting the solutions including the light-emitting elements from the inkjet head. In this case, the first substrate electrode and the second substrate electrode may be disposed to be spaced apart from each other on the substrate.

In the second arrangement operation S30, one end portions of the light-emitting elements may be arranged to be disposed on the first substrate electrode and the other end portions of the light-emitting elements may be arranged to be disposed on the second substrate electrode by applying power to the substrate.

According to the embodiments of the present invention, there is an advantage of improving an arrangement yield on a substrate by applying an electrode voltage to an electrode to rotate a light-emitting element before a jetting process is performed.

According to one embodiment of the present invention, since the electrodes are provided at the ejecting holes, the light-emitting elements are primarily arranged by applying the electrode voltage applied before and during ejecting, and thus there are advantages in that arrangement characteristics of the light-emitting elements can be improved and a product yield of a display device can be improved through an elaborate arrangement.

According to another embodiment of the present invention, a controller can control a magnitude of an electrode voltage independently of a piezoelectric element voltage, and there is an advantage in that the vertical falling performance of light-emitting elements can be improved by controlling the electrode voltage to have the same phase and the same magnitude as those of the piezoelectric element voltage.

Although the present invention has been described in detail through the exemplary embodiments, the scope of the present invention is not limited to the detailed description but should be interpreted based on the appended claims. In addition, those skilled in the art will understand that many modifications and variations are possible without departing from the scope of the present invention.

What is claimed is:

1. An inkjet head comprising:

nozzles each including a ejecting hole through which a solution including a light-emitting element is ejected; and pairs of electrodes which are provided around the ejecting holes to face each other and which apply an electrode voltage to the light-emitting element, wherein the nozzles are disposed to form one or more rows; and the electrodes include first electrodes provided in a row along one end portions of the plurality of adjacent nozzles and second electrodes provided in a row along the other end portions of the nozzles in a direction opposite to a direction of the first electrodes.

2. The inkjet head of claim 1, further comprising an insulating layer interposed between end portions of the nozzles and the electrodes.

3. The inkjet head of claim 1, wherein the first electrode is disposed a predetermined distance apart from the second electrode in one direction.

4. The inkjet head of claim 1, further comprising:

a first piezoelectric element which changes an internal pressure of a reservoir filled with the solution;

an actuator which changes a piezoelectric element voltage applied to the first piezoelectric element to eject the solution through the ejecting hole; and a controller which controls a magnitude of an electrode voltage applied to the electrode, wherein the controller controls the magnitude of the electrode voltage independently of the piezoelectric element voltage based on the piezoelectric element voltage.

5. The inkjet head of claim 4, further comprising a second piezoelectric element interposed between the end portions of the nozzles and the electrodes.

6. A method of ejecting an ink comprising:

a first arrangement operation of applying an electrode voltage to a ejecting hole of a nozzle through which a solution including a light-emitting element is supplied so as to arrange one end portion and the other end portion of the light-emitting element in an arbitrary direction;

a jetting operation of jetting the solution on a substrate on which a first substrate electrode and a second substrate electrode are disposed to be spaced apart from each other; and a second arrangement operation of applying power to the substrate so that the one end portion of the light-emitting element is disposed on the first substrate electrode and the other end portion is disposed on the second substrate electrode.

7. The method of claim 6, wherein, before a jetting process in the jetting operation is performed, the first arrangement operation and the jetting process are concurrently performable.

8. The method of claim 6, wherein, in the first arrangement operation, an electrode voltage having a magnitude which is different from a magnitude of a piezoelectric element voltage for ejecting the solution through the ejecting hole is applied.

* * * * *